United States Patent [19]

Leska, Sr.

[11] Patent Number: 4,757,775

[45] Date of Patent: Jul. 19, 1988

[54] CHAIN STITCHING APPARATUS

[75] Inventor: Paul J. Leska, Sr., Coon Rapids, Minn.

[73] Assignee: MTS Systems Corporation, Minneapolis, Minn.

[21] Appl. No.: 932,302

[22] Filed: Nov. 19, 1986

[51] Int. Cl.[4] ..... D05B 1/06; D05B 29/08

[52] U.S. Cl. ..... 112/198; 112/34; 112/221; 112/239

[58] Field of Search ..... 112/34, 197, 198, 201, 112/221, 222, 223, 239

[56] References Cited

U.S. PATENT DOCUMENTS

| | | | |
|---|---|---|---|
| 687,777 | 12/1901 | Parkes | 112/221 X |
| 881,283 | 3/1908 | Arndt et al. | 112/34 |
| 1,283,471 | 11/1918 | Corrall | 112/239 |
| 2,003,461 | 6/1935 | Pearson | 112/34 |
| 2,119,225 | 5/1938 | Dobyne et al. | 112/34 |
| 2,202,388 | 5/1940 | Leveque | 112/34 |
| 2,497,231 | 2/1950 | Monroe | 112/198 X |

FOREIGN PATENT DOCUMENTS

| | | | |
|---|---|---|---|
| 173142 | 7/1906 | Fed. Rep. of Germany | 112/239 |
| 938946 | 2/1956 | Fed. Rep. of Germany | 112/221 |
| 646383 | 11/1950 | United Kingdom | 112/197 |

*Primary Examiner*—Wm. Carter Reynolds
*Attorney, Agent, or Firm*—Kinney & Lange

[57] ABSTRACT

Apparatus for reinforcing or attaching composite structural materials by chain-stitching. A reciprocating head is powered to alternate between outward and return motions. A needle is mounted for outward and return movement with the head, the needle having a material piercing end and a notch adjacent the material piercing end. A cast off has a first portion configured to overlie the notch, to maintain a thread within a notch, and a second portion configured to expand a loop in the thread on release of the thread from the notch. The needle pierces the material on outward motion of the head and withdraws through the material, with the thread in the needle notch, during the return motion of the head. The cast off first portion overlies the needle notch during a part of the needle return movement and moves in trailing relation to the needle during a part of the needle outward movement. A pressure foot may also be commonly driven, with the needle and cast off, by the head.

7 Claims, 1 Drawing Sheet

CHAIN STITCHING APPARATUS

BACKGROUND OF THE INVENTION

1. Field of the Invention

The present invention relates generally to apparatus for chain-stitching materials and, particularly, to a stitching foot for chain-stitching composite structural materials with a single thread.

2. Description of the Prior Art

Sewing machines which, among other things, seam two or more layers of material to each other are notoriously old. Typically, such machines employ two threads which are interlocked in stitches formed by the sewing machine. In a typical prior art sewing machine of this type, shuttles or rotary hooks are employed on one side of the material with a needle alternately piercing and withdrawing from the material from its other side. In such machines, one thread is "threaded" through an eye in the needle while the other thread is contained in the shuttle or in a bobin associated with the rotary hook.

A difficulty encountered in sewing machines of the type described resides in establishing and maintaining the timing and position of the various components. For example, a reciprocating motion for the needle is established on one side of the material. A mechanical movement on the other side of the material must be timed and positioned with sufficient precision such that a shuttle can pass through a loop formed by the needle, or that loop can be engaged by the rotating hook. Generally, the mechanisms on both sides of the material are driven by a common power supply, such as an electric motor.

The noted timing and position problems increase with the span of the material to be stitched (without folding or otherwise doubling the material over on itself). This span is limited by the length of the linkages extending to the precision mechanisms on opposite sides of the material. Clearly, a greater span of material may be accommodated by extending the linkages. This, however, has practical limits given the precision necessary in the motion of the mechanisms and the fact that this precision is required on both sides of the material.

With many modern materials, discussed more fully below, it may not be possible (or desirable) to fold them for stitching. Thus, the span of materials that can be stitched is seriously limited by the required precision of the distinct stitch forming mechanisms. This is particularly true when those mechanisms are provided with the necessary strength (and attending mass) required to work with modern structural materials.

As an introduction, the above discussion is focused on a typical "two-thread" sewing machine. It is known, however, that a chain stitch sewing machine produces seams having greater resilience than the described two-thread devices. Thus, for structural applications, chain-stitching machines are very desirable.

Typical prior art chain stitch sewing machines work with a single thread that is "threaded" through the eye of a needle, the needle alternately piercing and withdrawing from the material being stitched from one side. A gripper hook operates on the other side of the material to grab a loop formed by the needle, as it pierces and withdraws from the material, and holds or retains that loop for passage or entry by the needle during the next piercing movement of the needle. Thus, while the described single-thread, chain stitch sewing machine produces seams having greater resilience, and therefore of greater value in the seaming of structural materials, such machines nonetheless require precision mechanisms on both sides of the material with the movement of those mechanisms being precisely timed. Thus, the limitations inherent in the prior art two thread machines described above, with regard to the span of material that may be accommodated, exist also in the described prior art chain-stitching machine.

Modern technology is developing many structural materials which it may be necessary, or desirable, to stitch for reinforcement or for the joining of structural components. For example, modern aircraft are made increasingly of non-metallic composite materials which have the requisite strength, without the weight of metal. Other advantages, such as the ability to avoid detection by radar, may also be possible with a reduction or elimination of metallic components. As indicated, composite structures of these types are known and in use. These structures may be laminated or otherwise formed so as to benefit from reinforcement by stitching at intervals along their span. In addition, structural components may be joined by stitching. In many cases, these materials are rigid and of significant dimension such that a sewing machine in accordance with the prior art, as described, requires significantly long dual linkages.

SUMMARY OF THE INVENTION

The present invention provides apparatus for producing chain stitches with a single thread and, particularly, a stitching foot which is positioned on one side of the material being stitched and which performs many of the functions of the prior art mechanisms positioned on opposing sides of the material being joined. For this reason, the present invention is particularly adapted for use with structural materials, either to reinforce those materials or to join components formed of those materials to each other. Specifically, the present invention employs a reciprocating needle having a piercing end and a notch positioned adjacent the piercing end. The needle pierces the material being stitched from one side of the material to position the notch on the other side of the material. On that other material side, a thread is positioned to be engaged by the notch such that a loop is withdrawn through the material to the first material side on withdrawal of the needle from the material. Thus, a loop is formed on the same side of the material from which the needle enters the material. A cast off is provided having a first portion configured to overlie the needle notch and moves synchronously with the needle during a part of the needle's withdrawal from the material—that part of the needle's withdrawal after emergence of the notch from the material. During this part of the needle movement, the cast off maintains the thread within the needle notch. As the needle moves to the next piercing movement, the cast off moves in trailing relation to the needle and notch such that the cast off engages the previously formed loop as the thread of that loop emerges from the needle notch. A second cast off portion retains the engaged loop for passage of the needle during its next withdrawal from the material.

As is apparent from the above discussion, loop formation and retention and passage through the loop by the needle to complete the chain stitch are accomplished on a single side of the material. All that is required on the other side of the material is a positioning of the thread relative to the needle such that the needle notch will engage the thread and withdraw it, as a loop, through the material. This "other side" movement is much less precise in timing and position than prior art systems employing a gripper hook for engaging a loop and retaining that loop for passage by the needle during the next needle cycle. Accordingly, sychronization between mechanisms on two material sides are much more easily attained in accordance with the present invention than in the prior art systems and can be more easily accomplished while accommodating a greater span of material than with the described prior art devices.

In a preferred embodiment of the present invention, the stitching foot includes a reciprocating head alternating between outward and return motions. A needle and cast off, described above, are mounted for outward and return movement during movement of the head. A pressure foot is also provided, the pressure foot being adapted to contact the material during the formation of a stitch therein. The pressure foot is adapted for movement with the head during the head outward and return motions. Various stops, motion limits, detents and similar devices are disclosed for assuring proper relative movement between the components of the stitching foot.

BRIEF DESCRIPTION OF THE DRAWINGS

FIG. 1 also illustrates the interaction between the illustrated stitching foot and structural materials and components with which it may be employed.

DETAILED DESCRIPTION OF THE PREFERRED EMBODIMENTS

Figure 1:
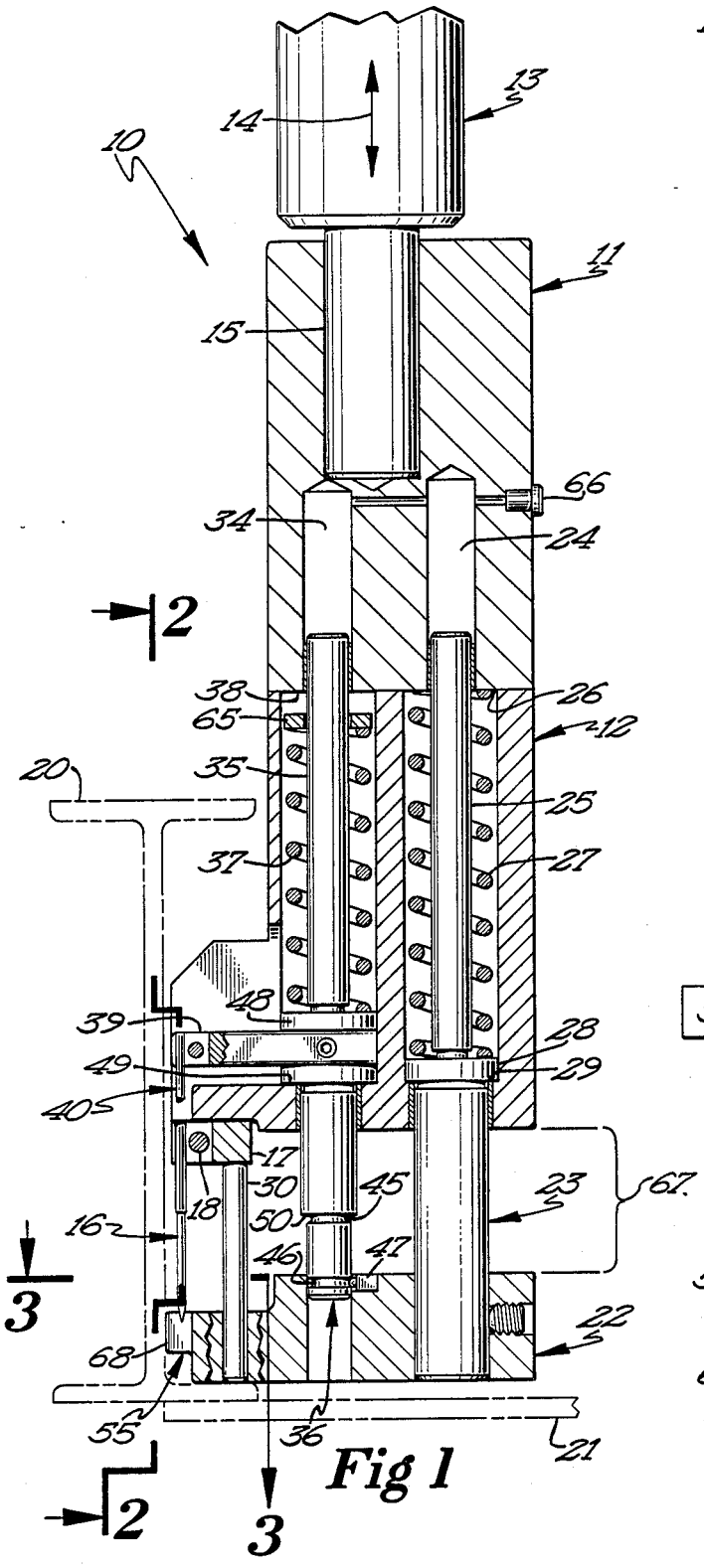
FIG. 1 is a partial cut-away of a side view of a stitching foot in accordance with the present invention, the cut-away corresponding in most respects to a central cross section through the stitching foot.

FIG. 1 shows a cut-away of a side view of a stitching foot 10 in accordance with the present invention, the cut-away corresponding in most respects to a central cross section through the stitching foot 10. The stitching foot 10 includes a reciprocating head formed of elements 11 and 12, the elements 11 and 12 being joined to each other in any desired manner and being formed as separate elements for purposes of assembly of the reciprocating head. Reciprocating outward motion (downward in the sense of the drawing figures) and return motion (upward in the sense of the drawing figures) is imparted to the reciprocating head by a reciprocating member 13, the reciprocating movement being indicated by the double headed arrow 14. In the illustrated embodiment, element 13 may be a cam follower driven by a cam on a rotating shaft. In such a construction, the rotating shaft provides the sole power to the stitching foot 10 to drive all of the components forming a part of the stitching foot 10. In a general sense, the reciprocating motion imparted to the cam follower 13 is a sinusoidal motion although appropriate dwells may be provided without departing from the scope of the present invention. For example, a dwell interval may be provided to increase the available time for positioning a thread relative to the needle of the stitching foot 10 (described below) to facilitate the positioning of the thread and render the timing of that thread positioning less critical. The cam follower 13 may be secured to the reciprocating head by a shaft 15, in any desired manner.

A needle 16 is mounted for movement with the reciprocating head of members 11 and 12 as by securing it with a plate 17, the plate 17 being carried by the member 12. Fastening between the members 12 and 17 may be in any desired manner while replacement of the needle 16, in the event of breakage or wear, for example, may be facilitated by parting the plate 17, at the insertion point of the needle 16. Engagement of the needle 16 by the plate 17 may be facilitated by a threaded member engaging the plate 17 parts, such as that illustrated at 18, for example. Reciprocating movement of the head, in outward and return directions, results in outward and return movement of the needle 16 in a manner essentially conventional in known prior art sewing machines.

Structural members or components are illustrated in phantom in FIG. 1 to demonstrate the utility of a stitching foot in accordance with the present invention and its stitching, in relation to such components. A first component is shown as a structural I beam 20 with a portion of the stitching foot of the present invention, including the needle 16, being positioned between the opposing flanges of the beam 20 and in close proximity to the beam 20 web. It is intended that a stitcher foot in accordance with the present invention be configured to fit between I beam flanges spaced no more than six inches from each other and to stitch within approximately 0.10 inch of vertical structural members, such as the I beam 20 web. Of course, a stitching foot in accordance with the present invention may be constructed to any desired dimensions. Positioned beneath the lower flange of the I beam 20 is a sheet of material 21. A chain stitch through the lower flange of the beam 20 and through the sheet 21 will result in a securement between the members 20 and 21 by a chain stitch seam. In addition to seaming, a chain stitch produced by the stitching foot 10 of the present invention may be employed to reinforce a single sheet of structural material, such as a laminate or composite material, for example.

A pressure foot 22 is carried by the stitching foot 10 and is adapted to engage and apply pressure to a material being stitched, such as the structural members 20 and/or 21, for example. The pressure foot 22 has a rod 23 fastened thereto, in any desired manner, and extending from the pressure foot 22 into a cavity 24 in the reciprocating head of stitching foot 10. As shown, cavity 24 extends from the interior of the reciprocating head toward the surface of that head in the general direction of the outward motion of the head.

The portion of the cavity 24 in member 11 has a smaller diameter than the cavity 24 portion in member 12 while member 11. The reduction in cavity 24, from member 12 to member 11, provides a shoulder 26 against which one end of a compression spring 27 presses. The other end of compression spring 27 engages a shoulder portion 28 of rod 23 such that movement of the rod 23 into the cavity 24 results in the compression of the spring 27. Thus, during an outward motion of the reciprocating head of stitching foot 10 (toward the material being stitched) the pressure foot 22 will first engage that material while continued outward motion will result in a compression of the spring 27 and a pressure on the material and pressure foot 22. As is known in the art, such pressure will serve to hold the material in place during penetration by the needle 16 as well as provide a stripping force to allow a withdrawal of the needle 16, and thread carried by the needle, from the material. A shoulder 29 is provided within the member 12 of the reciprocating head to limit the extension of the rod 23 from the reciprocating head. A guide 30 is secured to the pressure foot 22 and extends into a guiding aperture 31 that extends through the plate 17 and into the member 12. The rod 30 will slide within the aperture 31 on relative movement between the pressure foot 22 and the reciprocating head of the stitching foot 10 to maintain the orientation of the pressure foot 22 relative to the reciprocating head.

A second cavity 34 extends from the interior of the reciprocating head toward the head surface in the general direction of outward movement of the head. The cavity 34 includes a reduced diameter portion within the member 11 in which a reduced diameter portion 35 of a rod 36 will slide. A larger diameter portion of cavity 34 lies within member 12 of the reciprocating head and contains a compression spring 37, the spring 37 being engagable by a shoulder 38 at the junction of the members 11 and 12. The spring 37 and shoulder 38 are spaced from each other in the relative positions illustrated in FIG. 1, but cooperate to result in compression of the spring 37 in a manner described below. A spacer 65 may be positioned around the rod portion 35 to adjust or "tune" the timing of the compression of spring 37. Also, a vent such as that indicated generally at 66 may be provided as an exhaust and intake as the rods move in the cavities 24 and 34.

Figure 2:
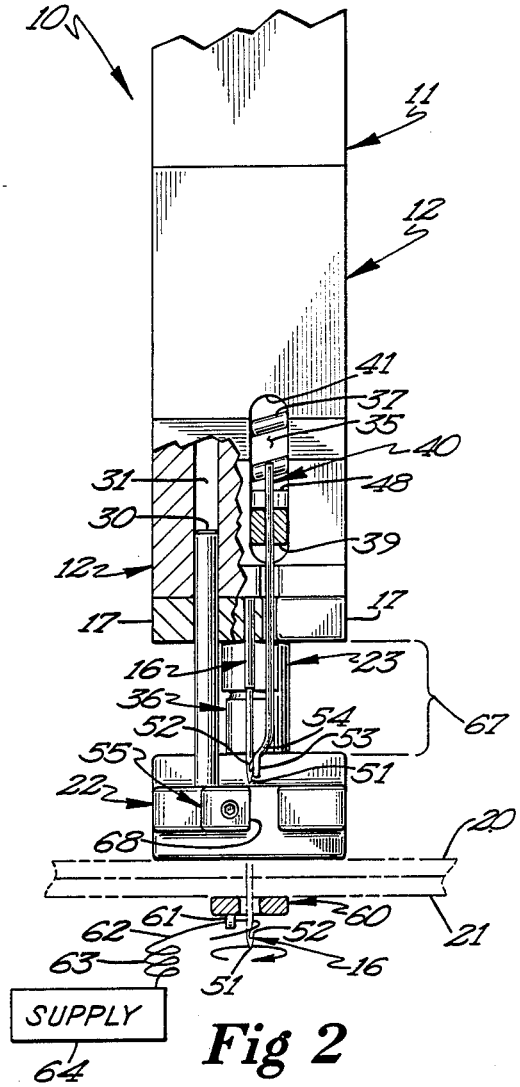
FIG. 2 is a cross section of the embodiment of FIG. 1 taken along the line 2—2 in FIG. 1 with a further diagramatic illustration of a mechanism by which a thread used in stitching may be operatively positioned relative to the needle of the stitching foot.

A beam 39 is secured to the rod 36 and carries a cast off 40, the cast off 40 extending generally parallel to the needle 16 (see FIG. 2). A chamber 41 is provided within the reciprocating head of stitching foot 10 to allow the beam 39 and cast off 40 to move relative to the head. The beam 39 may be secured to the rod 36 and to the cast off 40 in any desired manner, it being particularly advantagous to structure the connection between the beam 39 and cast off 40 such that the cast off 40 can be easily replaced or repaired.

That portion of the rod 36 extending from the reciprocating head of stitching foot 10 includes a first annular recess 45 and a second annular recess 46. The recesses 45 and 46 are configured to cooperate with a detent 47 contained within the pressure foot 22. The detent 47, in cooperation with one of the recesses 45 and 46, acts to prevent motion of the rod 36 relative to the foot 22. For example, with the detent 47 engaging the recess 46, the rod 36 is secured against movement, relative to the pressure foot 22, and against a force imparted by spring 37 on the rod 36 via an enlarged shoulder portion 48 of the rod 36. The shoulder portion 48 of rod 36 also cooperates with a shoulder 49 of member 12 to limit the extension of the rod 36 from the reciprocating head. A stop surface 50 in the form of a shoulder on rod 36 provides a positive stop for movement of the rod 36 relative to the pressure foot 22 by engagement with the pressure foot 22. This stop 50 acts, through the rod 36 and beam 39, to prevent penetration of a material being stitched by the cast off 40.

With particular reference to FIG. 2, it can be seen that the needle 16 includes a material piercing end 51 and a notch 52 adjacent the end 51. The notch 52 of the needle 16 has upwardly inclined edges such that a thread within the notch 52 will be retained within the notch during an upward movement of the needle (by the lower inclined surface) and be "ramped" out of the notch 52 on downward movement of the needle by the upper inclined surface of the notch 52. The cast off 40 includes a first portion 53 which is configured to overlie the notch 52 and to maintain a thread within the notch 52 when in that overlying relation, and a second portion 54. The portion 54 of cast off 40 is configured to expand a loop formed by the needle 16 as the thread which forms that loop leaves the notch 52 of needle 16, and to maintain that loop in position for passage by the needle during the next loop forming portion of the chain stitching cycle. Pressure foot 22 may include any appropriate guide for the needle 16 and cast off 40.

The position of the tip of the needle 16, including notch 52, after that needle has passed through material being stitched such as 20 and 21, is illustrated in phantom in FIG. 2. In this position, a thread may be engaged by the notch 52 to be withdrawn, as a loop, through the materials 20 and 21. Positioning of the thread relative to the notch 52, may be accomplished in any desired manner. It is presently contemplated that an annular "twirler" (shown diagramatically at 60) may be employed for this purpose, the needle 16 passing through a central opening in the twirler 60. The twirler 60 may include an extending member 61 which carries a thread 62, rotation of the twirler 60 causing the member 61 to pass around the needle 16 with the thread 62 carried by the member 61 being positioned for engagement by the notch 52. The coils 63 in the thread 62 represent appropriate tensioning devices while a supply of thread 64 is also illustrated. Supply 64 may also include suitable conditioning systems for the thread, as necessary. It is presently believed that, at least with some structural materials, the thread 62 may be advantageously formed of Kevlar. Other thread materials may be employed in the practice of the present invention. It can be seen, however, that a simple thread positioning mechanism, having a relatively noncritical timing and position relative to the stitching foot 10 may be employed on the "other" side of the materials 20 and 21 to result in engagement of a thread 62 by the notch 52. Thus, the precision in timing and position required in the prior art mechanisms (on both sides of the material being stitched) is avoided. Specifically, the present invention establishes a loop on the same side of the material from which the needle enters that material and retains that loop, still on that same material side, for passage of the needle during the next needle cycle. In short, those mechanisms whose timing and relative positions are critical are found on one side of the material being stitched.

In operation, the stitching foot 10 of the present invention is positioned relative to the materials to be stitched with the pressure foot 22 slightly above those materials. Outward movement of the reciprocating head will cause the pressure foot 22 to engage the materials. Continuing outward movement by the reciprocating head will result in a compression of the spring 27 and closing of the gap identified at 67 in FIG. 1. It should be noted that during the outward movement of the reciprocating head, the needle 16 is moving toward the materials. Continuing outward movement will result in an engagement of the spring 37 by the shoulder 38 (and any washer 65) to result in a force on the rod 36. However, the recess 46 and detent 47 will act against this force causing the rod 36 to extend into the cavity 34. In this manner, detent 47 and recess 46 hold the cast off 40 stationery, relative to needle 16, establishing a "trailing" relation between the cast off 40 and needle 16. Continuing outward movement of the reciprocating head will cause sufficient compression of the spring 37 (as established or "tuned" by the relative gap between the shoulder 38 and spring 37, as well as the thickness of the washer 65, if any) to overcome the detent 47 causing the rod 36 to extend into the pressure foot 22 and engage the surface 50. Stop 50 will stop the cast off 40 at the surface of the materials being stitched to prevent a penetration of those materials by the cast off 40.

Prior to the time that the spring 37 overcomes the detent 47, the downward movement of the needle 16 will cause a loop (formed during the next preceeding needle cycle) to leave the notch 52. That is, the thread which forms that loop will "ride" the upper inclined surface of the notch 52 out of the notch 52. After emergence of the loop from the notch 52, the spring 37 will overcome the detent 47 causing the cast off 42 to advance and engage that loop. The portion 54 of the cast off 40 will expand the loop and maintain the loop in position such that the needle will pass through that loop during its next upward or withdrawal movement. As will be apparent to those familiar with the art, during that "next" upward or withdrawal movement of the needle, the loop expanded by the cast off 40 will be shed by the cast off as it moves upwardly with the needle. As indicated, during the downward movement of the reciprocating head, the movement of the cast off 40 is retarded relative to the movement of the needle 16 to result in a trailing relation in the movement of the cast off 40 relative to the needle 16.

On full outward movement of the reciprocating head, the gap 67 will be closed and the recess 45 will be engaged by the detent 47. In this position, the needle 16 will fully penetrate the materials being stitched and a thread may be positioned relative to the needle notch 52 to be withdrawn, as a loop, through the materials, being stitched on upward movement of the needle 16. As indicated, a dwell may be provided between the driving cam and the cam follower 13 to lengthen the time available for thread engagement.

As the reciprocating head begins its return movement, the gap 67 begins to open. However, the spring 27 maintains a force on the pressure foot 22. Also, the recess 45 will be engaged by the detent 47 to maintain the cast off 40 in position immediately adjacent the materials being stitched. However, the needle 16 will begin to withdraw. As the needle notch 52 emerges from the materials being stitched, the shoulder 49 of the member 12 will engage the shoulder portion 48 of rod 36 causing the cast off 40 to begin an upward movement, that movement being synchronously timed with the movement of the needle 16. During this synchronous movement, the portion 53 of the cast off 40 is in overlying relation to the notch 52 of needle 16 to maintain a thread within that notch while the previously formed loop is shed. Also, the force exerted on the rod 23, by the spring 27, will provide a stripping force to the pressure foot 22 to facilitate withdrawal of the needle 16 from the materials being stitched. During stitch formation, the stitching foot 10 may be stepped along the surface of the materials being stitched, the movement being in accordance with the desired stitch length, while tensioning of the stitch may be maintained from the "other" side of the material as represented at 63.

Figure 3:
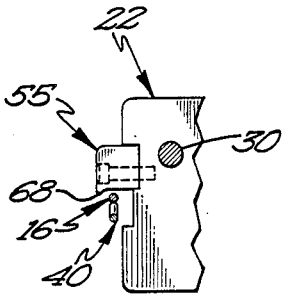
FIG. 3 is a view as seen along the line 3—3 in FIG. 1.

Obviously, many modifications and variations of the present invention are possible in light of the above teachings. For example, the materials being stitched may be moved relative to a stitching head without departing from the spirit of the invention. Also, while a stitching head in accordance with the present invention may be structured to provide a low profile for stitching between structural members, any desired configuration may be employed. Further, some threads, such as those formed of twisted filaments, may have a tendency to untwist resulting in a tendency to twist or rotate in a loop formed by the needle. To address this tendency to rotate, a block 55 (see FIG. 3) may be provided whose surface will maintain opposing segments of the loop parallel to each other. This insures entrapment of the loop by the cast off. The block 55 may have a hook portion 68 to further insure that the loop will not slide off or around the block 55. It is therefore to be understood that, within the scope of the appended claims, the invention may be practiced otherwise than is specifically described.

What is claimed is:

1. A stitching foot for use during chain-stitching of composite structural materials comprising:

reciprocating head means alternating between outward and return motions, said head means having at least one elongated cavity extending from the head means interior to its surface in the general direction of outward head means motion;

needle means having a material piercing end and a notch adjacent the material piercing end, the needle means being mounted for outward and return movement with the head means;

cast off means having a first portion configured to overlie the notch in said needle for maintaining a thread within said notch and a second portion configured to expand a loop in the thread on release of the thread from the notch;

means powered by movement of said head means for moving said cast off means synchronously with said needle means during a part of said needle means return movement, said cast off means first portion overlying said needle means notch during said part of said needle means return movement, and for moving said cast off means outward in trailing relation to said needle means during a part of said needle means outward movement;

pressure foot means adapted to contact said material during the formation of a stitch therein and including rod means extending into one head means cavity for movement therein;

stop means limiting the withdrawal of said pressure foot means rod means from said one head means cavity;

bias means within said one cavity for urging said rod means to the limit of said stop means while allowing further extension of said rod means into said one cavity against said bias means;

said cast off means moving means comprising:

second rod means positioned and movable within a second head means cavity and extending from said second cavity to said pressure foot means;

beam means carrying said cast off means and secured for movement with said second rod means;

detent means carried by said pressure foot means and acting on said second rod means to prevent movement of said second rod means relative to said pressure foot means; and means responsive to outward motion by said head means for urging movement of said second rod means with said head means, said second rod movement urging means overcoming said detent means after a predetermined outward motion by said head means.

2. The stitching foot of claim 1 further comprising means for limiting the outward movement of said cast off means.

3. The stitching foot of claim 1 further comprising means establishing a positive limit on outward movement of said cast off means for preventing penetration of the material being stitched by said cast off means.

4. The stitching foot of claim 3 further comprising means for maintaining said cast off means at its outward movement limit during a part of the return motion of said head means.

5. The stitching foot of claim 1 further comprising second stop means limiting the extension of said second rod means from said second cavity, said outward motion responsive means comprising resilient means within said second cavity for urging said second rod means against said second rod stop means.

6. The stitching foot of claim 5 further comprising means establishing a positive limit on outward movement of said cast off means for preventing penetration of the material being stitched by said cast off means.

7. The stitching foot of claim 6 further comprising means for maintaining said cast off means at its outward movement limit during a part of the return motion of said head means.

* * * * *